US011696372B1

(12) United States Patent
Schultz et al.

(10) Patent No.: US 11,696,372 B1
(45) Date of Patent: Jul. 4, 2023

(54) SPRING INDUCTION HEATER

(71) Applicants: PETERSON AMERICAN CORPORATION, Southfield, MI (US); INTERPOWER INDUCTION PROCESS EQUIPMENT, INC, Almont, MI (US)

(72) Inventors: Willard W Schultz, Novi, MI (US); Jeffrey C Osborn, Oakland TWP, MI (US); Ronald N Check, Brighton, MI (US); Gary M Gariglio, Metamora, MI (US)

( * ) Notice: Subject to any disclaimer, the term of this patent is extended or adjusted under 35 U.S.C. 154(b) by 749 days.

(21) Appl. No.: 16/698,708

(22) Filed: Nov. 27, 2019

Related U.S. Application Data

(60) Provisional application No. 62/772,346, filed on Nov. 28, 2018.

(51) Int. Cl.

| | |
|---|---|
| ***H05B 6/42*** | (2006.01) |
| ***C21D 1/63*** | (2006.01) |
| ***H05B 6/44*** | (2006.01) |
| ***C21D 11/00*** | (2006.01) |

(52) U.S. Cl.
CPC ... *H05B 6/42* (2013.01); *C21D 1/63* (2013.01); *C21D 11/005* (2013.01); *H05B 6/44* (2013.01)

(58) Field of Classification Search
CPC ..... H05B 6/42; H05B 6/44; C21D 1/63; C21D 11/005; C21D 9/02
See application file for complete search history.

(56) References Cited

U.S. PATENT DOCUMENTS 8,912,472 B1* 12/2014 Kurylo et al. ..... H05B 6/36 267/74
9,045,807 B1* 6/2015 Rode et al. ..... C21D 1/63

* cited by examiner

*Primary Examiner* — Scott R Kastler
(74) *Attorney, Agent, or Firm* — Ronald R. Kilponen

(57) ABSTRACT

A spring induction heater assembly is shown and described. The device has a quench tank incorporated into the design. A motor and drive mechanism provide rotation of a spring about one axis from a first position used for loading, to a second position for heat treatment with an induction coil and a third position where the spring is released dropped into a quench tank. Another rotational system is operational to rotate the spring on a spindle in the second or horizontal position while the spring is located between at least two legs of an induction coil. The induction coil provides even heating to the spring coils thereby providing desired changes to the material properties. The quench tank can have an automated system to remove the springs from the quench tank.

4 Claims, 7 Drawing Sheets

SPRING INDUCTION HEATER

CROSS REFERENCE TO RELATED APPLICATIONS

This application claims the benefit of Provisional Application for Patent Serial Number 62/772346 filed on Nov. 28, 2018 and is hereby incorporated by reference.

FIELD

The present version of these embodiments relate generally to the field of induction heating devices and methods used to heat treat springs.

BACKGROUND

These embodiments relate to devices and methods to treat coil springs, and more particularly to a device and method for the heat treatment of coil springs in a more efficient manner via the use of induction coils.

When springs are manufactured they are generally made from a specific diameter of wire and coiled into a particular spring diameter with a particular number of coils per inch or unit of measurement. When manufacturing is done, many times the material properties have been upset by the manufacturing process or alternatively the material properties need to be improved. The material properties of the coiled springs can be enhanced by a post manufacturing process which can improve the hardness of the coil springs and improve other material properties. This process many times uses a furnace where many coiled springs (the batch) are placed into a furnace which has either a heated liquid or heated atmosphere at a specified temperature. The batch is then maintained at this chosen temperature for a specific length of time. When this time period has been obtained, the batch can be dropped into a quench tank which quickly cools the batch thereby changing the material properties.

As one can appreciate, to get up to temperature a large quantity of material, for example, a treating media or bath, can require much energy and time. As an example, it can take several days for a treating media to become heated such that it becomes the liquid necessary for the treatment operation. During this time period, no production is done but significant energy is used. Once the media comes up to a temperature that is required, then treatment of the batch can commence. If for some reason treatment is required at a lower temperature, then production must wait until the temperature of the media cools, which is also time consuming and costs production time.

Another method to treat springs is with heated air in a furnace. To heat air to an elevated temperature for extended periods of time likewise can require much time and energy. When one batch of springs have been treated via this process, if another batch of springs need a treatment but at a different temperature or for a shorter or longer period of time it can take much time to adjust the temperature of the air in the oven. This can decrease the efficiency of any manufacturing process which thereby increases the costs of energy and the costs of the finished materials or product.

For the foregoing reasons, there is a need for a spring induction heater and treatment process for the treatment of batches or individual coil springs.

SUMMARY

In view of the foregoing disadvantages inherent in the heated media or bath and heated air treatment process - there is a need for an induction coil spring heat treatment process and method.

A first objective of these embodiments is to provide a system that is relatively energy efficient.

Another objective of these embodiments is to provide a system that can be brought up to operational temperature quickly.

It is yet another objective of these embodiments to provide a system that can have the operational temperature changed relatively quickly.

It is a still further object of these embodiments to provide a system that can treat more than one spring at a time.

An additional objective is to provide an embodiment that is at least partially automated. These together with other objectives of these embodiments, along with various features of novelty which characterize these embodiments, are pointed out with particularity in this application forming a part of this disclosure. For a better understanding of these embodiments, the operating advantages and the specific objectives attained by its uses, reference should be had to the accompanying drawings, descriptive matter and claims in which there is illustrated a preferred embodiment.

DETAILED DESCRIPTION OF THE PREFERRED EMBODIMENTS

Figure 1:
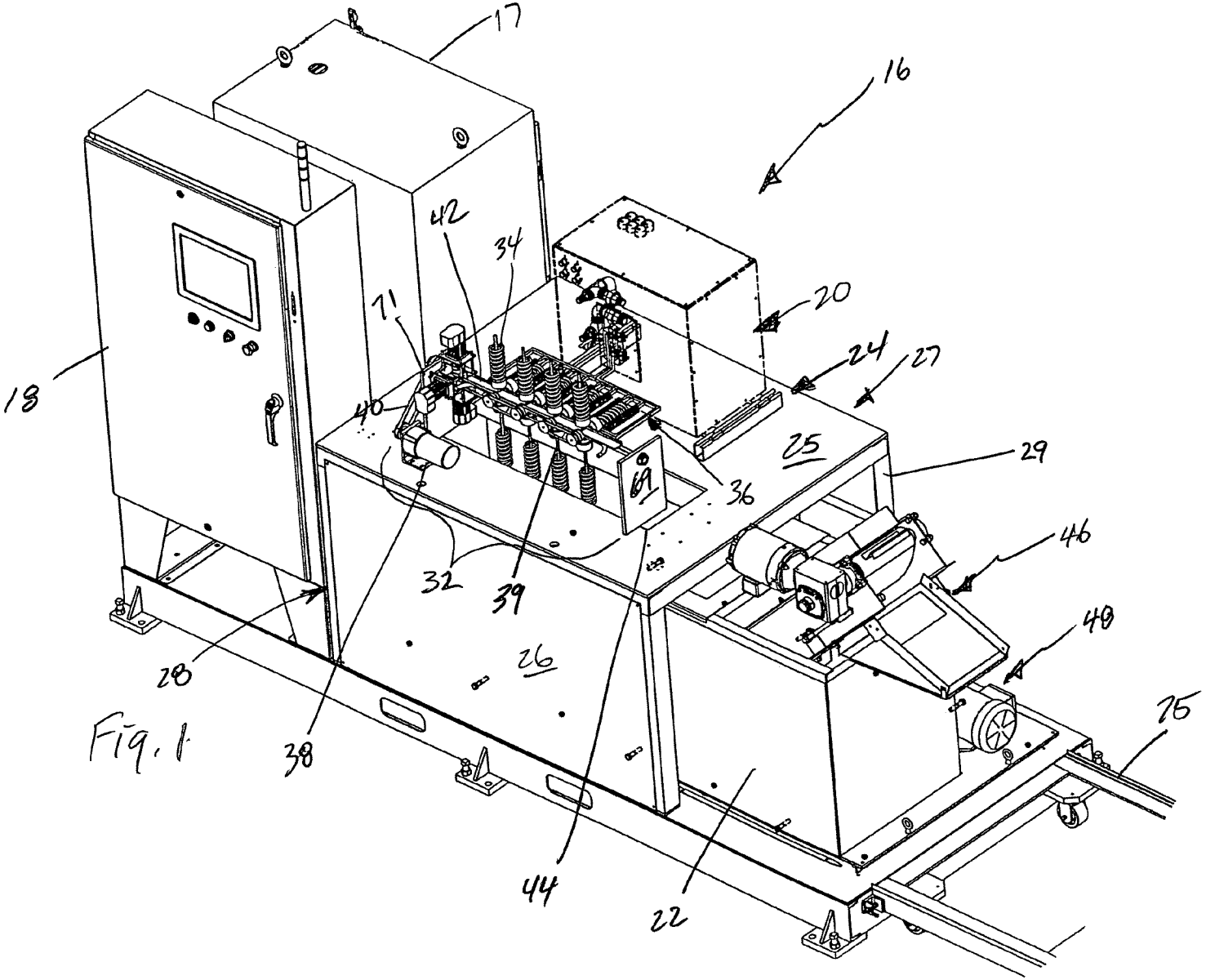
FIG. 1 shows a top perspective view of one embodiment of an Induction Heater Assembly.

Referring to the drawings in detail wherein like elements are indicated by like numerals, there is shown in FIG. 1 a top perspective view of one embodiment of the spring induction heater or Induction heater assembly 16. The heater assembly 16 has two control boxes 17, 18 near the first end 28 for controlling the various components in the assembly 16. In the middle of the assembly is housing 24 having a top 25, left side 26, right side 27, first end 28 and second end 29.

Located on the top 25 is a spring retention device 32. The spring retention device 32 is for holding at least one spring 34. There is a hole 44 in the top 25 of housing 24. Also attached to the top 25 is a induction control box 20. The induction control box 20 controls the induction coils 36 which are mounted between the control box 20 and spring retention device 32, better seen in FIGS. 2 and 3. FIG. 1 shows the device with the top plate 54 removed for clarity, see FIG. 5 also.

Figure 3:
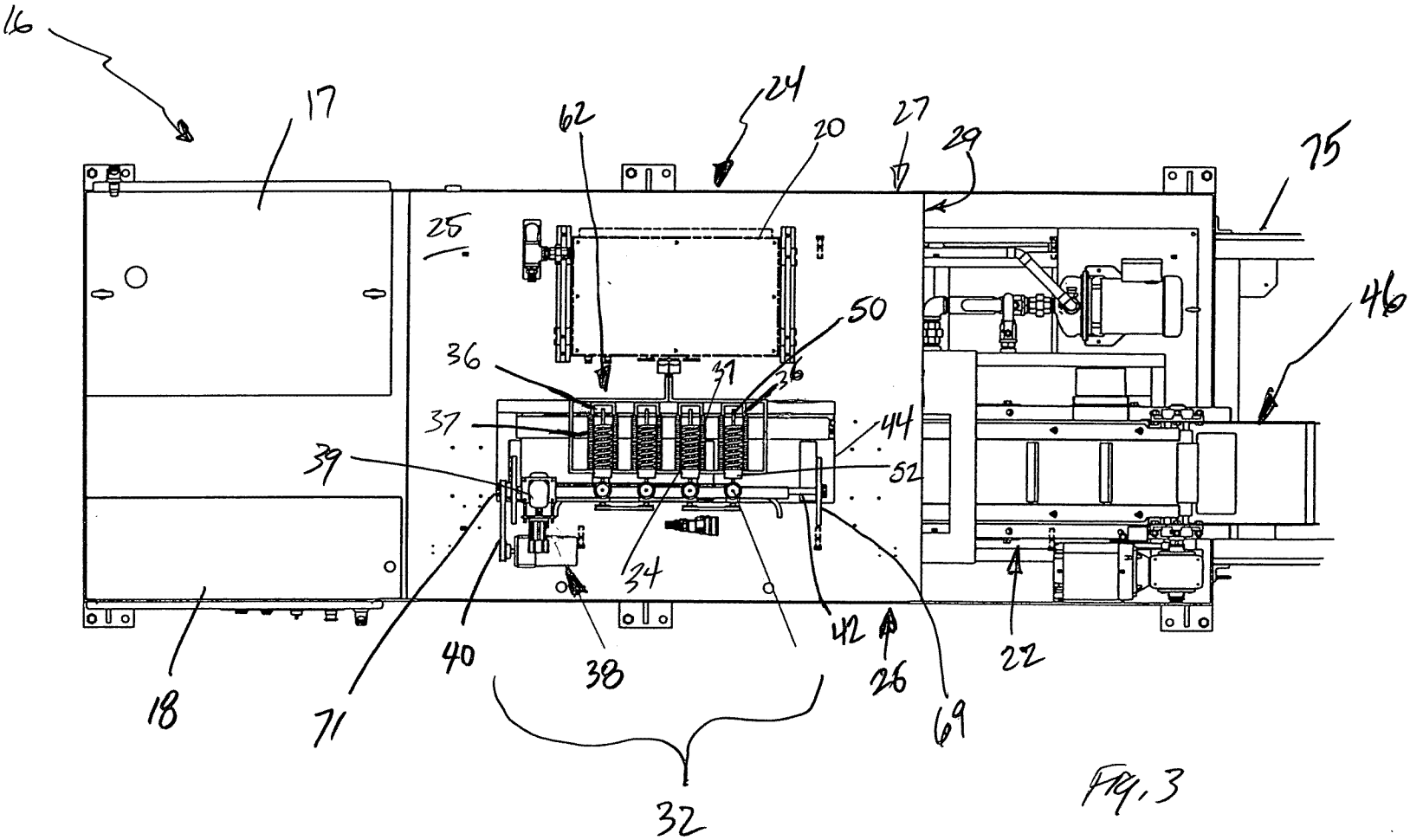
FIG. 3 shows a partial top view of one embodiment of the Induction Heater Assembly.

The second end 29 of the housing 24 is mostly open and this allows a quench tank 22 and related structure to reside within the housing 24, FIGS. 1, 3 generally. The quench tank 22 is located such that when springs 34 are dropped from the spring retention device 32 through hole 44 they land in the liquid contained within the quench tank 22.

The quench tank 22 can also have a pump and heater 48 to keep the quenching liquid at a desired temperature. The quench tank 22 can also have an apparatus 46 such as a conveyor (as an example and not a limitation) for removing the springs 36 from within the tank when they have soaked to the desired time and/or recovery temperature. The quench tank 22 can also be located on rails 75 for removal and insertion of the quench tank 22 into and from within the housing 24.

Figure 2:
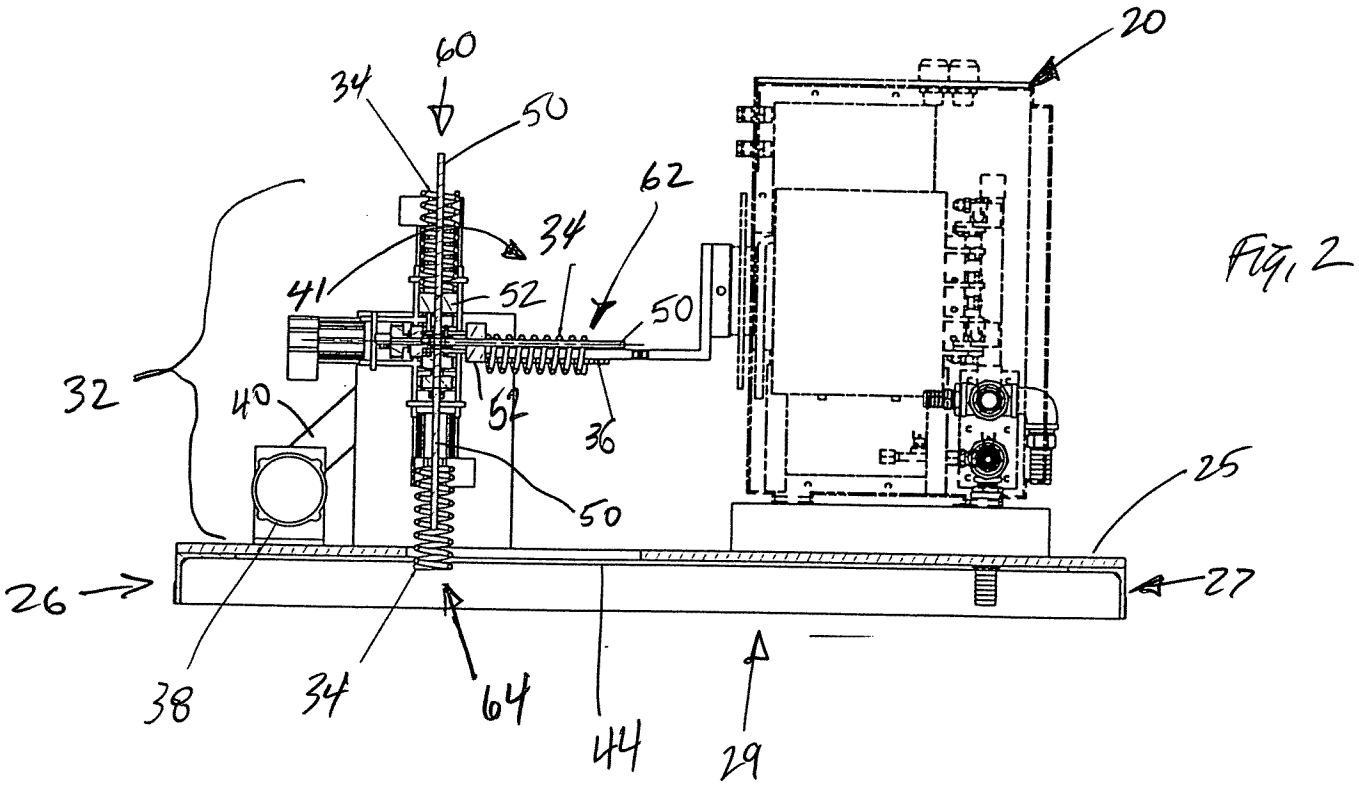
FIG. 2 shows a partial second end view of one embodiment of the Induction Heater Assembly.

FIG. 2 shows a second end view of one embodiment of the spring retention device 32, induction coil 36 and induction control box 20 of the induction heater assembly 16. This figure shows the positions of the springs 34 as they are treated. The first position 60 shows a spring 34 loaded onto a spindle 50 (upright vertical position). The springs 34 can be manually loaded onto the spindle 50 or other machinery could be utilized for this function (not shown).

When the spring 34 is loaded on the spindle 50 of the spring retention device 32 (the first position), one end of the spring rests on the cap 52. The motor 38 and drive mechanism 40 rotates the shaft 42 of the spring retention device 32 such that the spring 34 moves from the first position 60 which is approximately vertical, to the second position 62 which is approximately horizontal.

In the second position 62, the spring 34 inner surface rests on the spindle 50 and the base of the spring 34 is retained by the cap 52. The cap 52 and spindle 50 then begin to rotate in a horizontal axis causing the spring 34 to rotate between the legs 37 of the induction coil 36, see FIGS. 3, 5. An appropriate amount of current is fed to the induction coil 36 from the induction control box 20 and the spring 34, while being rotated, is evenly heated to the desired temperature. The cap 52 and spindle 50 are driven by the motor 38 and the required gearing.

This thereby treats the spring 34 with heat evenly on all coils of the spring 34 from the top of the spring 34 to the bottom or base of the spring 34 such that the material properties are changed to those desired by the operator.

When the spring 34 has acquired the proper temperature treatment, the motor 38 and drive mechanism 40 rotate the spring 34 to the third position 64 (FIG. 2) where the spring 34 is released and drops through the hole 44 into the quench tank 22.

The spring 34 remains in the quench tank 22 for an appropriate or user defined amount of time and is then removed. The quench tank 22 can have an apparatus 46, FIG. 3, for removing springs 34 from the tank automatically or they could be removed manually.

FIG. 3 shows a top view of the induction heater assembly 16. The top plate 54 (see FIG. 5) is removed for clarity in this FIG. 3. In this view the springs 34 are shown to be in the second position 62. It is shown that each of the springs 34 are located between the legs 37 of their own induction coil 36. In other words, there is one induction coil 36 and each induction coil 36 has two legs 37 one appropriately spaced on each side of each spring 34. Each induction coil 36 can be individually controllable independent of one another. An alternative embodiment provides for one control for all the induction coils 36.

In theory, each of the springs 34 could be treated by their own induction coil 36 or in this embodiment all four springs 34 can be treated at the same treatment temperature. While this embodiment shows four springs being treated at one time, it should be appreciated that more or fewer springs 34 could be treated at the same time by easily modifying the device.

Figure 4:
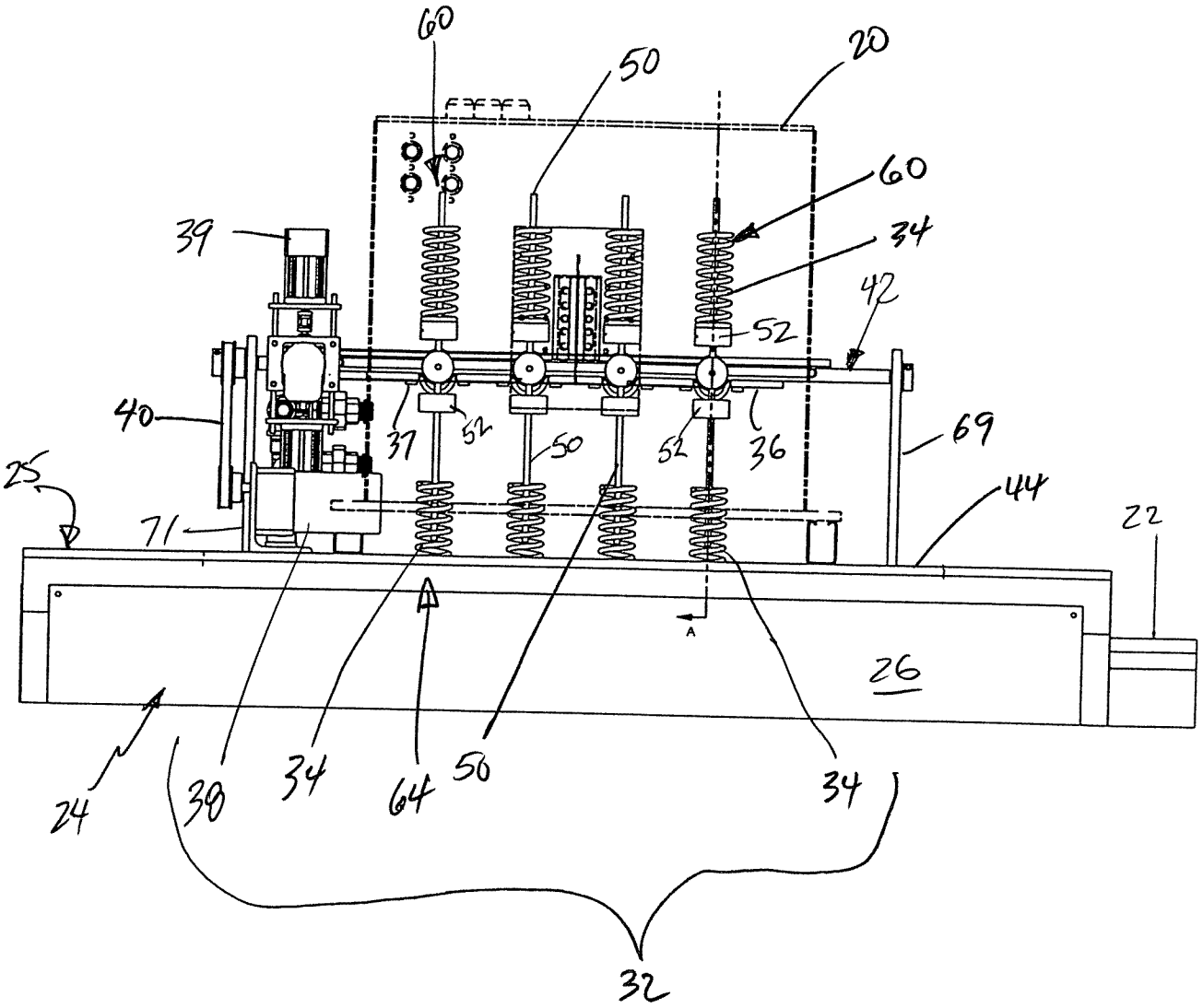
FIG. 4 shows a left side view of portions of one embodiment of the Induction Heater Assembly.

FIG. 4 shows a partial left side view of one embodiment of the induction heater assembly 16 or a more detailed view of the spring retention device 32 and related elements. FIG. 4 shows a spring 34 in the first position 60 and in the third position 64 as it is falling off of the cap 52 and spindle 50 towards the quench tank 22 (not shown).

Figure 5:
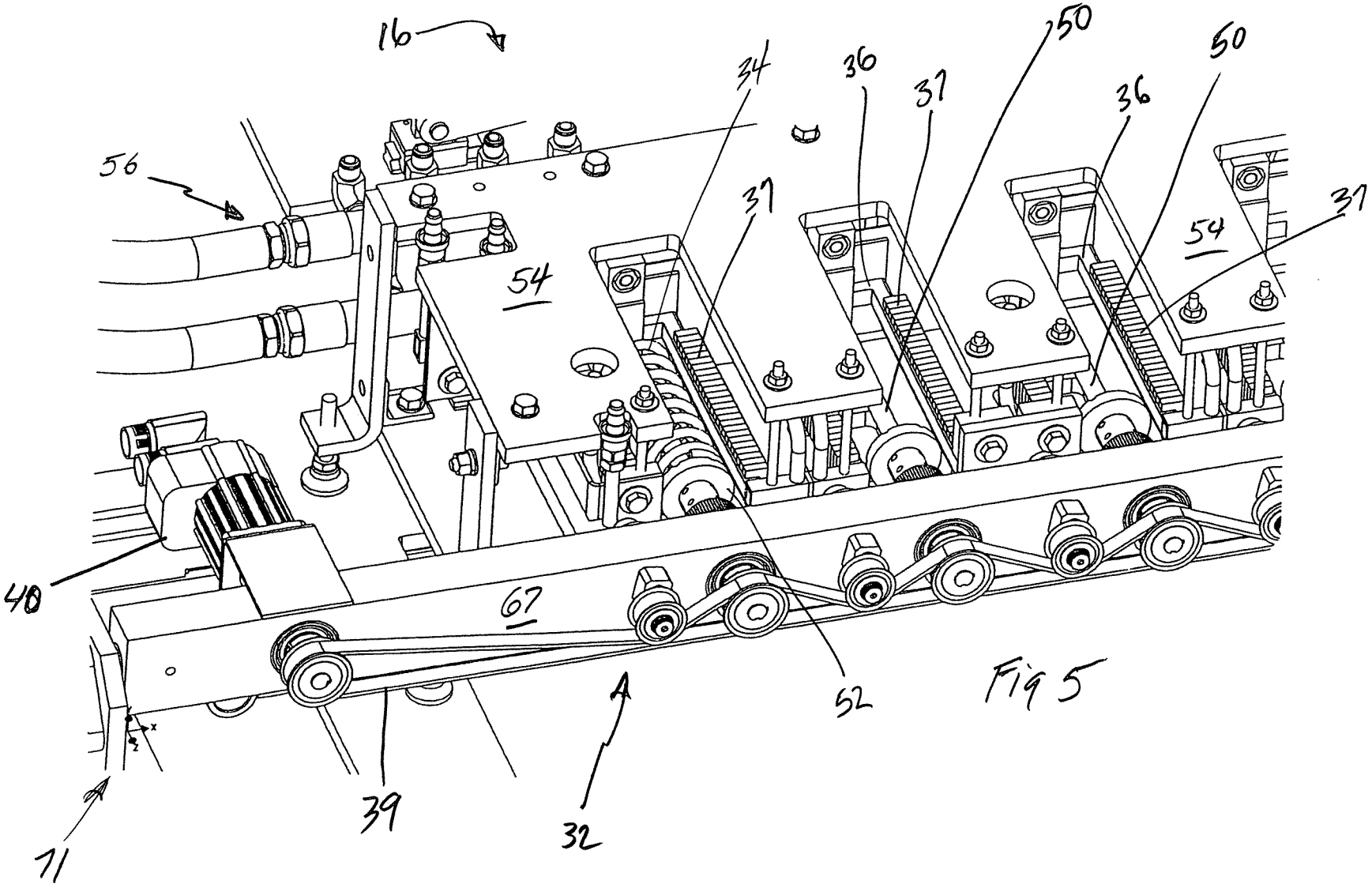
FIG. 5 shows partial top perspective cutaway view of one embodiment of the Induction Heater Assembly.

FIG. 5 shows a partial cutaway view of one embodiment of the induction heater assembly 16. This view shows a cooling system 56 that can be affixed near the induction coils 36 and can thereby prevent them from overheating or cool them to a preferred temperature. FIG. 5 also shows a partial view of the top plate 54. In this figure, there is only one spring 34 shown as being treated. The other spindles 50 are vacant. Also shown in FIG. 5 is the spring retention device 32 having a beam 67. The drive mechanism 40 is affixed to the beam 67 and to a belt 39 which provides rotation to the spindles 50, caps 52, related elements and thereby any springs 34 located there upon.

Figure 6:
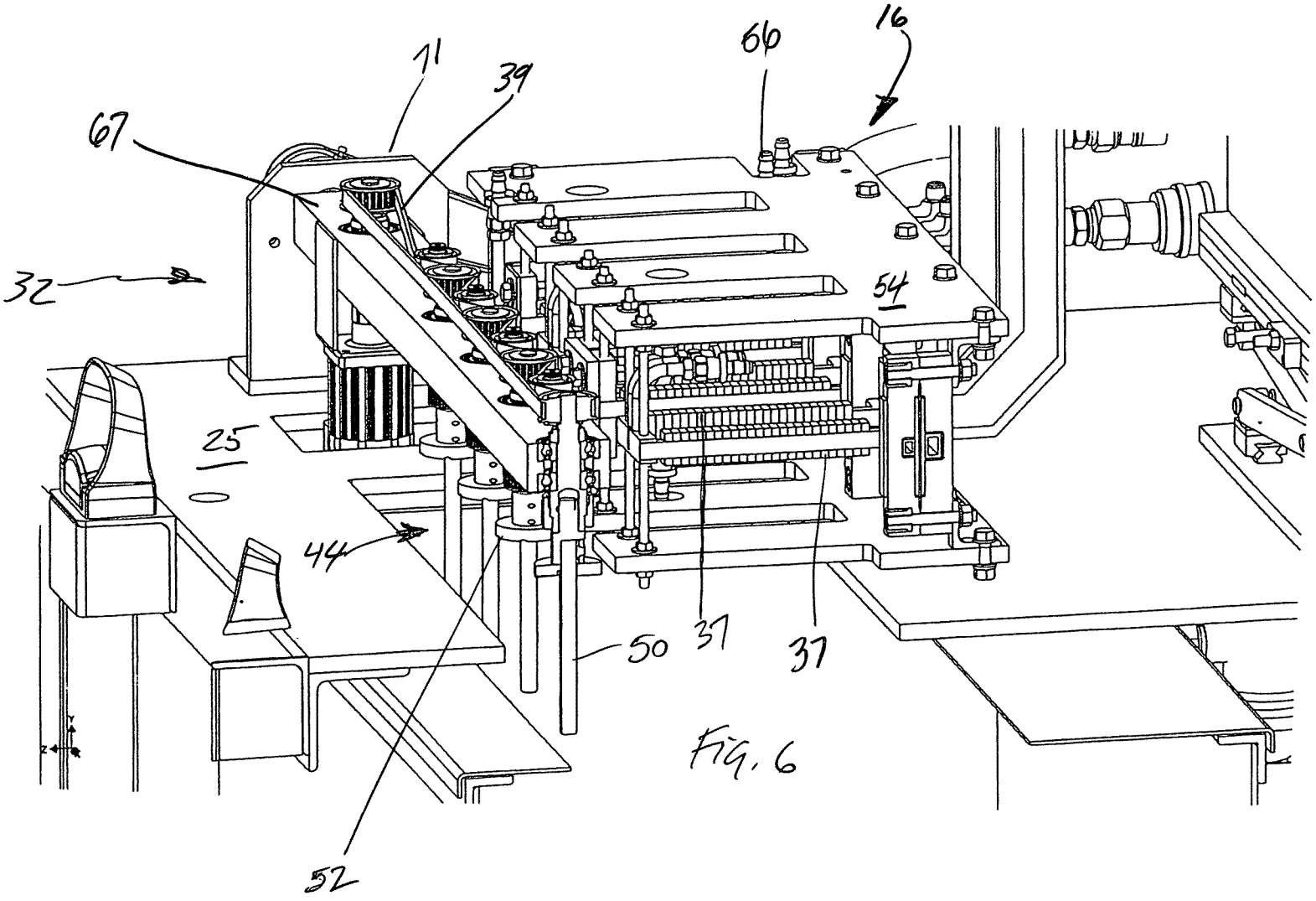
FIG. 6 shows another partial second end cutaway view of one embodiment of the Induction Heater Assembly.

FIG. 6 shows another partial cutaway view of the induction heater assembly 16. In this view it can be better seen how one embodiment has an induction coil leg 37 on each side of the spring 34 rotation area. This embodiment shows the spindles 50 in the third position 64, or the position where the springs 34 would be released from the spindles 50 and drop through the hole 44 and into the quench tank 22 (not shown in this view).

Figure 7:
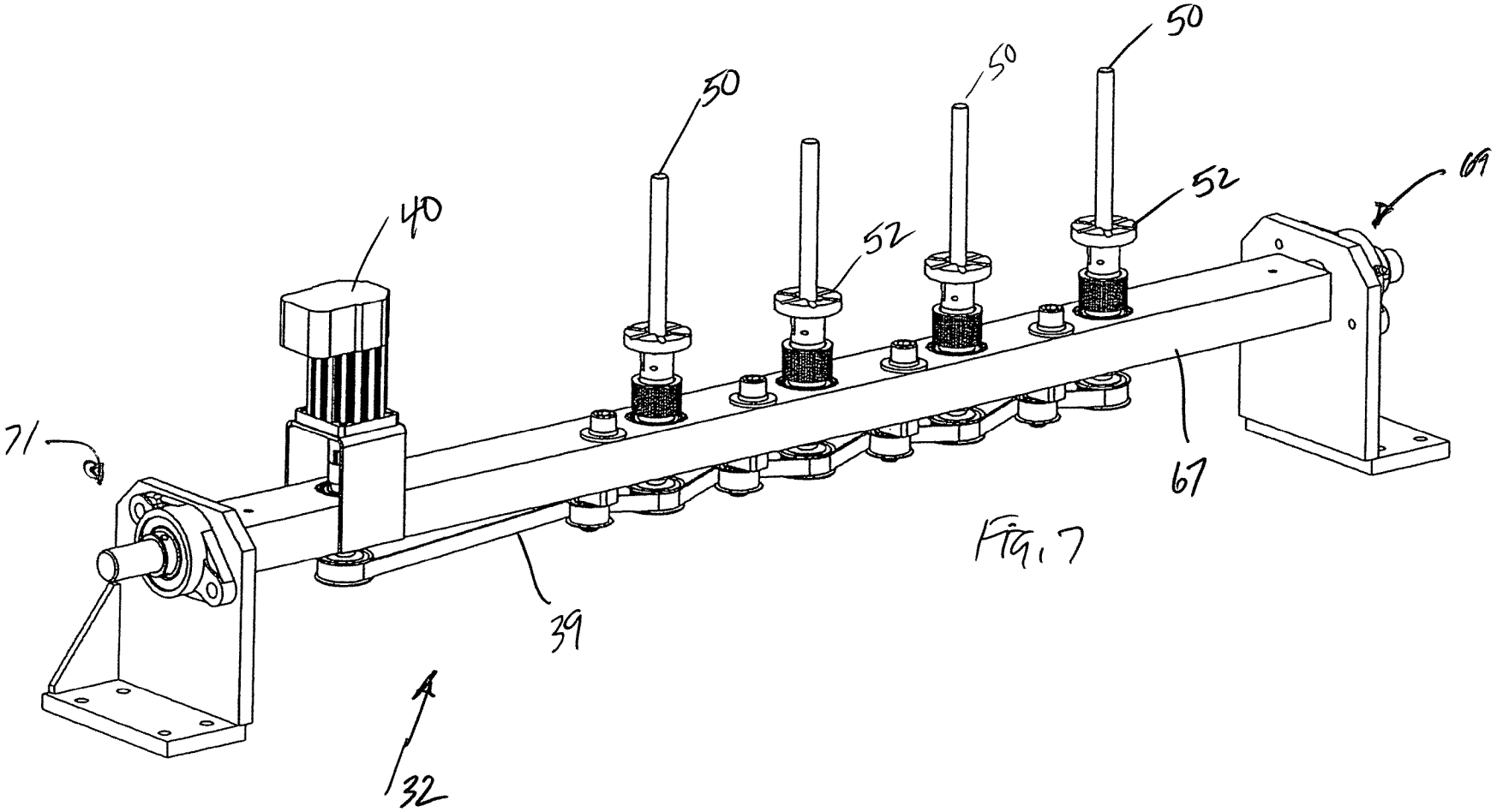
FIG. 7 shows a more detailed view of one embodiment of the spring retention device isolated.

FIG. 7 shows a more detailed view of the spring retention device 32. In this view, it can be better seen the first mount 69, second mount 71 and the interaction with the beam 67, belt 39 and the drive mechanism 40. This FIG. 7 also shows one embodiment of the caps 52 affixed to the spindles 50.

It will now be apparent to those skilled in the art that other embodiments, improvements, details and uses can be made consistent with the letter and spirit of the foregoing disclosure and within the scope of this application inclusive of the claims.

The invention claimed is:

1. A spring induction heater assembly, the device comprising:

a housing having a first end, second end, left side, right side and top;

an induction coil and induction coil control box mounted to the top, the induction control box for controlling the current and operation of at least one induction coil;

a spring retention device mounted to the top, the spring retention device having a mechanism for retaining, rotating, induction heating and releasing a spring;

the top having a hole, the hole located below the spring retention device; and a quench tank, the quench tank located below the hole for receiving a spring and;

a cooling system engaging the induction coil for preventing the induction coil from overheating and for lowering the temperature of the induction coil.

2. A spring induction heater assembly, the device comprising:

a housing, the housing having a first end, second end, left side, right side and top, the first and second control boxes affixed to the first end of the housing;

an induction control box, the induction control box mounted to the top of the housing, the induction control box for controlling the current and operation of at least one induction coil;

a spring retention device mounted to the top of the housing, the spring retention device having a mechanism for retaining, rotating, heating and releasing a spring;

the top of the housing having a hole, the hole located below the spring retention device, the hole for receiving springs released from the spring retention device;

a quench tank located below the hole, the quench tank for receiving and cooling the spring; and an apparatus affixed to the quench tank, the apparatus for removing springs from the quench tank after a predetermined time period.

3. A spring induction heater assembly, the device comprising:

a housing, the housing having a first end, second end, left side, right side and top;

an induction control box, the induction control box mounted to the top of the housing, the induction control box for controlling the current and operation of at least one induction coil;

a spring retention device mounted to the top of the housing, the spring retention device having a mechanism for retaining a spring on a spindle in an upright vertical or first position;

the spring retention device having a mechanism for rotating the spring and spindle from the upright position to a horizontal or second position;

the spring retention device having a mechanism for rotating the spring and spindle in a horizontal axis in the horizontal or second position;

the spring retention device having an induction coil located on a leg and located near the rotating spring and spindle, where the induction coil is heated to a predetermined temperature as the spring is rotated horizontally thereby evenly heating the coils of the spring;

the spring retention device having a mechanism for rotating the spring and spindle from the horizontal or second position to a vertical or third position where the spring is released from the spindle;

the top of the housing having a hole, the hole located below the spring retention device, the hole for receiving springs released from the spring retention device in the vertical position;

a quench tank located below the hole, the quench tank for receiving and cooling the spring; and an apparatus affixed to the quench tank, the apparatus for removing springs from the quench tank after a predetermined cooling time period.

4. The spring induction heater assembly of claim 3, further comprising;

a cooling system engaging the induction coils for preventing the induction coils from overheating and for lowering the temperature of the induction coils.

* * * * *